US010536785B2

(12) United States Patent
Ma et al.

(10) Patent No.: US 10,536,785 B2
(45) Date of Patent: Jan. 14, 2020

(54) HEARING DEVICE AND METHOD WITH INTELLIGENT STEERING

(71) Applicant: GN HEARING A/S, Ballerup (DK)

(72) Inventors: Changxue Ma, Barrington, IL (US); Rob De Vries, Tilburg (NL); Andrew Dittberner, Andover, MN (US)

(73) Assignee: Gn Hearing A/S, Ballerup (DK)

( * ) Notice: Subject to any disclaimer, the term of this patent is extended or adjusted under 35 U.S.C. 154(b) by 94 days.

(21) Appl. No.: 15/832,641

(22) Filed: Dec. 5, 2017

(65) Prior Publication Data

US 2019/0174235 A1 Jun. 6, 2019

(51) Int. Cl.
*H04R 25/00* (2006.01)

(52) U.S. Cl.
CPC ..... *H04R 25/407* (2013.01); *H04R 25/405* (2013.01); *H04R 25/43* (2013.01); *H04R 25/505* (2013.01); *H04R 25/552* (2013.01); *H04R 25/554* (2013.01); *H04R 25/60* (2013.01); *H04R 2225/51* (2013.01); *H04R 2430/20* (2013.01)

(58) Field of Classification Search
CPC .... H04R 3/005; H04R 25/405; H04R 25/407; H04R 25/552; H04R 25/554; H04R 2225/51; H04R 2225/53; H04R 2430/20
USPC ... 381/23.1, 312, 313, 317, 318, 321, 91, 92
See application file for complete search history.

(56) References Cited

U.S. PATENT DOCUMENTS

| | | | | |
|---|---|---|---|---|
| 6,154,552 | A | 11/2000 | Koroljow et al. | |
| 8,396,234 | B2 * | 3/2013 | Derleth | G10L 21/0208 381/312 |
| 8,630,431 | B2 * | 1/2014 | Gran | H04R 25/407 381/23.1 |
| 2010/0135500 | A1 * | 6/2010 | Derleth | H04R 25/552 381/23.1 |
| 2011/0116666 | A1 * | 5/2011 | Dittberner | H04R 25/50 381/313 |
| 2013/0329923 | A1 | 12/2013 | Bouse | |

OTHER PUBLICATIONS

Extended European Search Report dated Mar. 29, 2019 for corresponding European Application No. 18204484.2.
Certificate of Correction dated Oct. 30, 2001 for U.S. Pat. No. 6,154,552.

* cited by examiner

*Primary Examiner* — Huyen D Le
(74) *Attorney, Agent, or Firm* — Vista IP Law Group, LLP

(57) ABSTRACT

A method of operating a hearing device and a hearing device are disclosed. The method comprises obtaining a first microphone signal and a second microphone signal. The method comprises obtaining a first beamform signal based on the first microphone signal and the second microphone signal. The method may comprise obtaining a second beamform signal based on the first microphone signal and the second microphone signal. The method comprises determining a first parameter based on the first beamform signal. The method may comprise combining the first beamform signal and the second beamform signal based on the first parameter for provision of an output beamform signal. The method comprises providing the output beamform signal for further processing including hearing loss compensation.

18 Claims, 2 Drawing Sheets

HEARING DEVICE AND METHOD WITH INTELLIGENT STEERING

FIELD

The present disclosure relates to a hearing device of a binaural hearing system, a method of operating a hearing device.

BACKGROUND

Hearing device manufacturers face many challenges in providing hearing devices which imitate normal hearing and the human brain's perception, to give a satisfying hearing experience for hearing device users.

It remains challenging to develop hearing devices that work satisfactorily with the auditory system and the acoustic environment.

SUMMARY

Accordingly, there is a need for devices and methods that overcome or mitigate the disadvantages presented above. It is an object of the present disclosure to provide hearing devices and methods that enhance the acoustic experience of a hearing device user by improving the processing of the signals in the hearing device.

A method of operating a hearing device is disclosed. The method comprises obtaining a first microphone signal and a second microphone signal. The method comprises obtaining a first beamform signal based on the first microphone signal and the second microphone signal. The method may comprise obtaining a second beamform signal based on the first microphone signal and the second microphone signal. The method comprises determining a first parameter based on the first beamform signal. The method may comprise combining the first beamform signal and the second beamform signal based on the first parameter for provision of an output beamform signal. The method comprises providing the output beamform signal for further processing including hearing loss compensation.

A hearing device is disclosed. The hearing device comprises an antenna for converting a first wireless input signal of a first external source to an antenna output signal; and a radio transceiver coupled to the antenna for converting the antenna output signal to a transceiver input signal. The hearing device comprises a set of microphones comprising a first microphone for provision of a first microphone signal and a second microphone for provision of a second microphone signal. The hearing device comprises a beamforming module connected to the first microphone and the second microphone. The beamforming module comprises a first beamformer for providing a first beamform signal based on the first microphone signal and the second microphone signal, and optionally a second beamformer for providing a second beamform signal based on the first microphone signal and the second microphone signal. The beamforming module comprises a beamforming controller. The hearing device comprises a processing unit for processing input signals and providing an electrical output signal based on input signals; and a receiver for converting the electrical output signal to an audio output signal. The beamforming controller may be configured to determine a first parameter based on the first beamform signal; and to combine the first beamform signal and the second beamform signal based on the first parameter for provision of an output beamform signal.

It is an advantage of the hearing device and method disclosed herein that a more seamless switching between processing modes for compensating hearing loss in the hearing device is achieved. The disclosed method and hearing devices also enable a hearing loss compensation which increases acoustical transparency, which in turn reflects positively on the experience of the hearing device user. One or more embodiments described herein allow the hearing devices to switch to a perceptually appropriate mode for a specific user, aligning beamforming capabilities and other capabilities of signal processing algorithms with the acoustic environment and the user's hearing loss, preferences and/or intent.

A method of operating a hearing device includes: obtaining a first microphone signal and a second microphone signal; obtaining a first beamform signal based on the first microphone signal and the second microphone signal; obtaining a second beamform signal based on the first microphone signal and the second microphone signal; determining a first parameter based on the first beamform signal; combining the first beamform signal and the second beamform signal based on the first parameter for provision of an output beamform signal; and providing the output beamform signal for hearing loss compensation.

Optionally, the act of combining the first beamform signal and the second beamform signal comprises reducing a first gain for the first beamform signal from a first primary gain to a first secondary gain.

Optionally, the act of combining the first beamform signal and the second beamform signal comprises increasing a second gain for the second beamform signal from a second primary gain to a second secondary gain.

Optionally, the method further includes obtaining a third beamform signal based on the first microphone signal and the second microphone signal.

Optionally, the first beamform signal and the second beamform signal are combined with the third beamform signal based on the first parameter for provision of the output beamform signal.

Optionally, the method further includes controlling the first beamformer based on the first beamform signal and/or the first parameter.

Optionally, the method further includes determining a second parameter based on the second beamform signal.

Optionally, the method further includes determining a third parameter based on a third beamform signal.

Optionally, the act of combining the first beamform signal and the second beamform signal is also based on the second parameter and/or the third parameter for provision of the output beamform signal.

Optionally, the method further includes obtaining a contralateral signal from a contralateral hearing device.

Optionally, the act of combining the first beamform signal and the second beamform signal comprises increase a gain for the second beamform signal from a primary gain to a secondary gain.

A hearing device includes: a set of microphones comprising a first microphone for provision of a first microphone signal, and a second microphone for provision of a second microphone signal; a beamforming module connected to the first microphone and the second microphone, wherein the beamforming module comprises a first beamformer for providing a first beamform signal based on the first microphone signal and the second microphone signal, and a second beamformer for providing a second beamform signal based on the first microphone signal and the second microphone signal, wherein the beamforming module comprises a beamforming controller; a processing unit configured to provide an electrical output signal based on an input signal; and a receiver configured to provide an audio output signal based on the electrical output signal; wherein the beamforming controller is configured to: determine a first parameter based on the first beamform signal; and combine the first beamform signal and the second beamform signal based on the first parameter for provision of an output beamform signal.

Optionally, the beamforming controller is configured to combine the first beamform signal and the second beamform signal based on the first parameter by reducing a first gain for the first beamform signal from a first primary gain to a first secondary gain.

Optionally, the beamforming controller is configured to combine the first beamform signal and the second beamform signal based on the first parameter by increasing a second gain for the second beamform signal from a second primary gain to a second secondary gain.

Optionally, the beamforming controller is configured to obtain a third beamform signal based on the first microphone signal and the second microphone signal.

Optionally, the beamforming controller is configured to combine the first beamform signal, the second beamform signal and the third beamform signal based on the first parameter for provision of the output beamform signal.

Optionally, the beamforming controller is configured to combine the first beamform signal and the second beamform signal based on the first parameter by increasing a gain for the second beamform signal from a primary gain to a secondary gain.

Optionally, the hearing device further includes: an antenna for converting a first wireless input signal of a first external source to an antenna output signal; a radio transceiver coupled to the antenna for converting the antenna output signal to a transceiver input signal; wherein the radio transceiver is coupled to the processing unit.

Other advantageous and/or features will be described in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
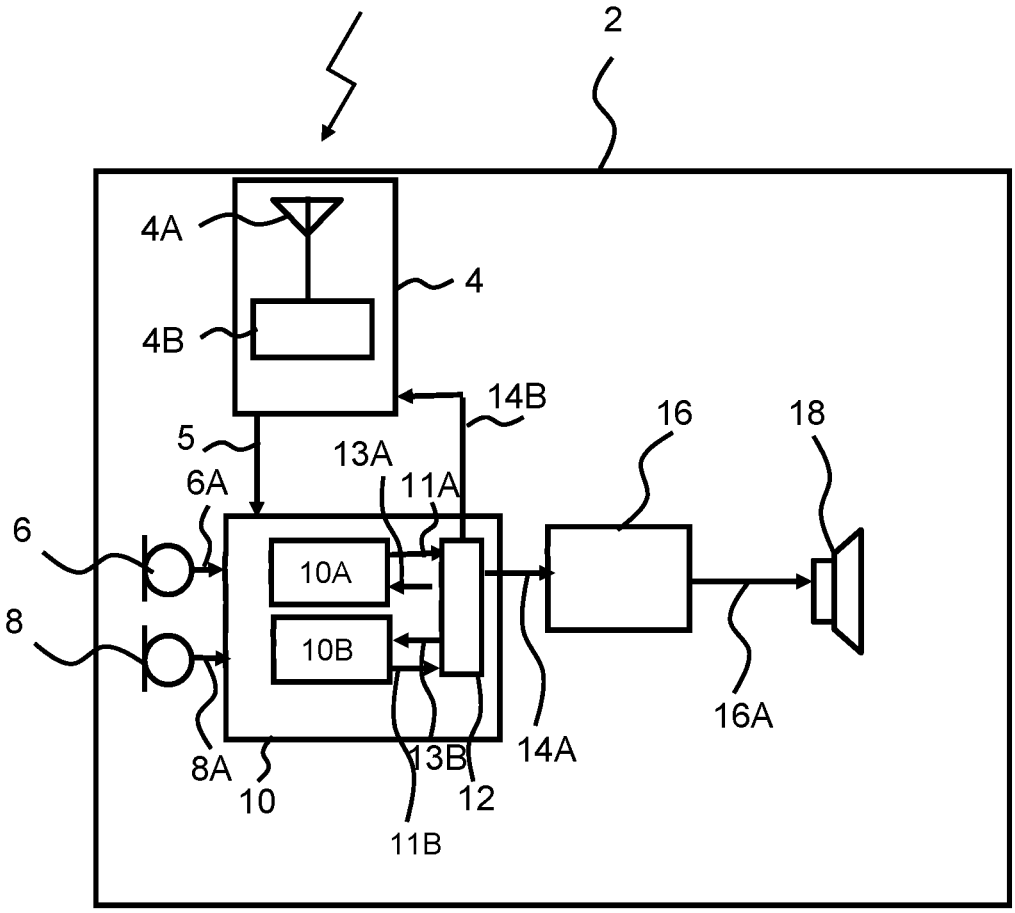
FIG. 1 schematically illustrates an exemplary hearing device according to this disclosure.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

A hearing system, such as a binaural hearing system, is advantageously capable of satisfying different listening priorities and needs in different acoustic environments. To compensate hearing loss and to provide a user with an acoustically transparent experience, the present disclosure proposes to develop hearing devices that synergistically work with the auditory system of the hearing device user, e.g. at the acoustical level, at the peripheral nervous system level, and/or at the central nervous system level. The present disclosure allows the auditory system to optimally process the incoming acoustic signal for performance and preference in any acoustic environment.

A hearing device may be configured to operate in various modes, such as a first mode, a second mode and/or a third mode. The inventors have discovered that detecting when to switch between the various modes is user specific. The inventors have found that parameters of an acoustic scene analysis to detect such a switch are also user specific. In other words, when a hearing device user's auditory system can no longer resolve the cocktail party problem, or how much of a head shadow effect needs to occur for the listener to focus on a single ear for SNR benefits, or when improvements in SNR at one or more hearing devices is desired is very subjective and very listener dependent. The present disclose proposes to determine individual listener differences and apply such determination to a decision steering logic of auditory scene analysis of the hearing device in an intelligent and transparent manner.

This disclosure relates to a method of operating a hearing device. The method comprises obtaining a first microphone signal and a second microphone signal, such as obtaining at least a first microphone signal and a second microphone signal (e.g. receiving a first microphone signal and a second microphone signal). The hearing device comprises an antenna for converting a first wireless input signal of a first external source to an antenna output signal; and a radio transceiver coupled to the antenna for converting the antenna output signal to a transceiver input signal. The hearing device comprises a set of microphones comprising a first microphone for provision of the first microphone signal and a second microphone for provision of the second microphone signal.

The method comprises obtaining a first beamform signal based on the first microphone signal and the second microphone signal, such as based on at least the first microphone signal and the second microphone signal (e.g. generating a first beamform signal). The method comprises obtaining a second beamform signal based on the first microphone signal and the second microphone signal, such as based on at least the first microphone signal and the second microphone signal (e.g. generating a second beamform signal). The hearing device comprises a beamforming module connected to the first microphone and the second microphone. The beamforming module comprises a first beamformer for providing the first beamform signal based on the first microphone signal and the second microphone signal, and a second beamformer for providing the second beamform signal based on the first microphone signal and the second microphone signal. The hearing device comprises a processing unit for processing input signals and providing an electrical output signal based on input signals; and a receiver for converting the electrical output signal to an audio output signal.

The method comprises determining a first parameter based on the first beamform signal. In one or more exemplary methods, determining a first parameter may be performed based on the first beamform signal and/or the second beamform signal. For example, a parameter (such as the first parameter, a second parameter, a third parameter, a fourth parameter) may comprise a signal-to-noise ratio, a noise gain, a noise reduction gain, a benefit in signal-to-noise ratio, and/or any related metric. A parameter (such as the first parameter, a second parameter, a third parameter, a fourth parameter) is seen as indicative of a mode, such as a first mode, a second mode, or a third mode. A mode relates to a mode of operation of the hearing device. For example, a mode may be selected among a first mode, a second mode, and/or a third mode. An exemplary first mode may be related to a spatial cue preservation mode, which is a mode used when the auditory system is able to perform source segregation of sounds (i.e. spatial perception). This sometimes refers to the situation where the brain is capable of solving the cocktail party problem. It may be envisaged that as long as the brain has the capacity to solve the cocktail party problem, preservation of spatial cues to complete this task remains a priority.

An exemplary second mode may be related to binaural listening mode, which is mode where the auditory system employs a strategy of spatial unmasking, i.e. the auditory system focuses on which ear provides the better signal to noise ratio (SNR) for the signal of interest to the listener in order to provide an improved perception of the signal but also the opposing ear is used to provide missing acoustic information about other sound sources caused by the head shadow effect. This occurs for example in environments where the noise source and signal of interest are spatially separate from each other and the head can mask some of the noise (ear dependent). The background noise is not diffused and tends to be asymmetric in loudness when compared between ears.

A third exemplary mode may be a speech intelligibility mode, which is a mode used when the cocktail party problem cannot be resolved by the auditory system, there is no better-ear SNR advantage (e.g. spatial unmasking) and noise surrounding the listener is diffuse (e.g. same level of noise detected at both ears). In this condition, the listener resorts to SNR improving tactics, such as turning an ear towards the signal of interest, moving closer to the signal of interest source, and/or use other sensory modalities such as visual cues (e.g. lip reading). The speech intelligibility mode is seen as aiming to provide maximal SNR improvements in both ears to supporting the listener in these types of complex listening environments and e.g. to attempt to elicit binaural squelch effect for the potential of addition 2-3 dB more SNR improvement (auditory system effect).

In one or more exemplary methods, determining the first parameter may comprise obtaining a decomposition of a plurality of beamforming filters (e.g. determining a plurality of beamforming filter coefficients). In one or more exemplary methods, a beamforming filter may be a filter with fixed filter coefficients, and/or an adaptive filter. It may be envisaged that the beamforming filters for the hearing device acting as monitor hearing device (e.g. acting as monitor ear) are fixed filter while the beamforming filters for the hearing device acting as focus hearing device (e.g. acting as focus ear) are fixed filters or adaptive filters. In the present disclosure, beamforming filters and algorithms are designed to characterize one or more modes disclosed herein, such as a first mode, a second mode, and/or a third mode by determining a signal-to-noise ratio, a noise gain, a noise reduction gain, a benefit in signal-to-noise ratio, and/or any related metric as first parameter. In one or more exemplary methods and hearing devices, a first mode (e.g. related to spatial cue preservation) is provided, where filters of the hearing device are generated so as to resemble or mimic a spatial response of a realistic ear to overcome the mismatch between the positions of microphones on the hearing device and the sound received by the ear drum which is filtered by the pinna and the ear canal. The inventors have found that the major difference in the mismatch is caused by the physical structure of the pinna. In the present disclosure, this is referred to as pinna restoration since this algorithm tries to mimic the acoustic effects of the pinna. It may be envisaged that a microphone and receiver in-the-ear (MaRIE) formfactor may be used to replace the use of filters for pinna restoration (e.g. mechanical solution for pinna restoration). The first mode related to e.g. spatial cue preservation allows for optimal source segregation by the auditory system of the hearing device user to occur resulting in natural spatial perception and awareness.

In one or more exemplary methods and hearing devices, a second mode (e.g. related to binaural listening) is provided, where filters of the hearing device are generated to improve the acoustic part of spatial unmasking (e.g. better ear strategy) while preserving or even enhancing the situational awareness of the listener at the same time. The filters of the second mode may be configured to optimize the head-shadow effect based on a bilateral beamforming algorithm by forming a focused beam pattern on one ear that provides optimal SNR conditions for signals at 0 degrees azimuth and elevation to the listener. In the present disclosure, this is referred to as focus ear. The opposite ear to the focus ear, referred to as the monitor ear, is seen as using filters configured to provide a 'true' omnidirectional beam pattern which includes and negates the head shadowing effect by utilizing the ear-to-ear audio streaming capability of the hearing devices and the microphone locations with respect to both ears. The focus ear may be chosen based on the ear providing the best SNR for a given acoustic environment that the listener happens to be in, giving priority to signals in front of the listener in SNR computations. When both ears provide a similar SNR, it may be envisaged that the focus ear may be determined based on the hearing loss of the wearer, where the ear with the least hearing loss is chosen as the focus ear.

In one more exemplary methods and hearing devices, a third mode (e.g. related to the speech intelligibility) is employed in noisy environments that are diffuse (i.e. noise on both sides of the hearing device are equal in loudness/intensity). In this mode, a bilateral beamforming may be based on the focused beam pattern (optionally similar to the binaural listening mode), utilizing the ear-to-ear audio streaming capability of the devices. The bilateral beamforming may be applied on both ears in this example.

The method comprises combining the first beamform signal and the second beamform signal based on the first parameter for provision of an output beamform signal. The beamforming module comprises a beamforming controller. The beamforming controller is configured to determine the first parameter based on the first beamform signal (and optionally the second beamform signal); and combine the first beamform signal and the second beamform signal based on the first parameter for provision of the output beamform signal. Combining the first beamform signal and the second beamform signal based on the first parameter for provision of an output beamform signal may be performed so as to initiate, perform and/or complete a shift from a given mode to another mode. It can be seen that combining the first beamform signal and the second beamform signal based on the first parameter (e.g. SNR, noise gain, noise reduction gain) may result in gradually shifting from a mode to another mode, such as from any one of the first mode, the second mode, and the third mode to any one of the first mode, the second mode, and the third mode. The disclosed methods and hearing devices allow the hearing devices to switch to the perceptually appropriate mode for the specific user, aligning the beamforming capabilities and other capabilities of the signal processing algorithms with the acoustic scenes and the users' hearing loss, preferences and intent.

The method comprises providing the output beamform signal for further processing including hearing loss compensation.

In one or more exemplary methods, combining the first beamform signal and the second beamform signal comprises reducing a first gain for the first beamform signal from a first primary gain to a first secondary gain. In one or more exemplary methods, combining the first beamform signal and the second beamform signal comprises stepwise (e.g. with a step parameter in range [0-1] and/or continuously using a reduction scheme (or function) dependent on the step parameter) reducing a first gain for the first beamform signal from a first primary gain to a first secondary gain. In one or more exemplary methods, combining the first beamform signal and the second beamform signal comprises increasing a second gain for the second beamform signal from a second primary gain to a second secondary gain. In one or more exemplary methods, combining the first beamform signal and the second beamform signal comprises stepwise (e.g. with a step parameter in range [0-1] and/or continuously using an increase scheme (or function) dependent on the step parameter) increasing a second gain for the second beamform signal from a second primary gain to a second secondary gain.

For example, combining the first beamform signal and the second beamform signal may comprise obtaining different directional patterns by filtering the first beamform signal and the second beamform signal (e.g. with finite impulse response (FIR) filters). In other words, combining the first beamform signal and the second beamform signal may comprise changing from a first directional pattern to a second directional pattern (such as from a mode to another mode). For example, changing from a first directional pattern to a second directional pattern may comprise performing a linear interpolation between a plurality of FIR filters. For example, let us assume that y1 a the first beamform signal and y2 as the second beamform signal in the following exemplary form:

$$y1=s_1*F_a+s_2*R_a \text{ and } y2=s_1*F_b+s_2*R_b$$

where $s_1$ is the first microphone input signal, and $s_2$ is the second microphone input signal, $F_a$, $R_a$, $F_b$, $R_b$ are appropriate filters to generate a beamform signal. Combining the first beamform signal and the second beamform signal may comprise changing from the first set of directional filters ($F_a$, $R_a$) to a second set of directional filters ($F_b$, $R_b$) which are applied to the microphone input signals. For example, changing from pattern A with associated FIR filters ($F_a$, $R_a$) on the front and rear microphones, to pattern B with associated FIR filters ($F_b$, $R_b$) can be achieved by applying the filters F and R on the first microphone input signal of the first (e.g. front) microphone and second microphone input signal and the second (e.g. rear) microphone, respectively and adding the resulting filtered signals where e.g.:

$$F=\alpha*F_a+(1-\alpha)*F_b \quad (1)$$

and $$R=\alpha*R_a+(1-\alpha)*R_b \quad (2)$$

and by steering parameter or step parameter $\alpha$ from 1 to 0. For example, steering between patterns (by changing $\alpha$ from 1 to 0) can be done in a linear or non-linear way. It may be envisaged as beneficial to change slowly in the beginning of the combining operation and fast when one becomes more certain that a change is desired, or the other way around in order to let a change in the environment match the change in the directional pattern.

In one or more exemplary methods, the method comprises obtaining a third beamform signal based on the first microphone signal and the second microphone signal (e.g. generating a third beamform signal).

In one or more exemplary methods, combining the first beamform signal and the second beamform signal based on the first parameter for provision of an output beamform signal comprises combining the first beamform signal, the second beamform signal and the third beamform signal based on the first parameter (e.g. SNR, noise gain, and/or noise reduction gain) for provision of an output beamform signal.

In one or more exemplary methods, the method comprises controlling a first beamformer based on the first beamform signal and/or the first parameter. The hearing device may comprise the first beamformer. The beamforming controller may be configured to control the first beamformer and optionally a second beamformer.

In one or more exemplary methods, the method comprises determining a second parameter based on the second beamform signal. In one or more exemplary methods, the method comprises determining a third parameter based on the third beamform signal. The second or third parameter is seen as indicative a mode, such as a first mode, a second mode, and/or a third mode. For example, the second parameter, or the third parameter may comprise a signal-to-noise ratio, a noise gain, a noise reduction gain, a benefit in signal-to-noise ratio, and/or any related metric.

In one or more exemplary methods, combining the first beamform signal and the second beamform signal based on the first parameter for provision of an output beamform signal comprises combining the first beamform signal and the second beamform signal based on the second parameter and/or third parameter for provision of an output beamform signal. Combining the first beamform signal and the second beamform signal based on the second parameter and/or third parameter may be performed so as to initiate, perform and/or complete a shift from a given mode to another mode.

In one or more exemplary methods, the method comprises obtaining a contralateral signal from a contralateral hearing device (e.g. receiving a contralateral signal). The contralateral signal may be indicative of the mode carried out at the contralateral hearing device. The contralateral signal may be indicative of what type of beamforming scheme (e.g. coefficients, or whether the beamforming scheme is indicative of the contralateral hearing device operating as a focus ear or as a monitor ear) takes place at the contralateral hearing device. In one or more exemplary methods, the method comprises determining a fourth parameter based on the contralateral signal, and combining the first beamform signal and the second beamform signal may be performed based on the fourth parameter. For example, the fourth parameter may comprise a signal-to-noise ratio, a noise gain, a noise reduction gain, a benefit in signal-to-noise ratio, and/or any related metric.

In one or more exemplary methods, combining the first beamform signal and the second beamform signal based on the first parameter for provision of an output beamform signal comprises combining the first beamform signal and the second beamform signal based on the second parameter, third parameter, and/or fourth parameter for provision of an output beamform signal. In one or more exemplary methods, the method comprises combining any one or more of the first beamform signal and the second beamform signal with the contralateral signal based on one or more parameters. For example, in a binaural hearing system comprising a right hearing device and a left hearing device, the output beamform signal may be computed as a linear combination of the left and right beamforming output signal:

$$\text{bilateralBeamformer}_l=(1-w_l)*\text{leftMonauralBeamformer}+w_l*\text{rightMonauralBeamformer} \quad (3)$$

$$\text{bilateralBeamformer}_r=(1-w_r)*\text{rightMonauralBeamformer}+w_r*\text{leftMonauralBeamformer} \quad (4)$$

where w denotes a beamforming coefficient, the subscript l denotes left hearing device and r denotes the right hearing device.

In an illustrative example where the disclosed technique is applied, when in a second mode related to binaural listening or when in a third mode related to speech intelligibility (e.g. with bilateral beamforming), the first parameter comprises noise reduction gain, which is determined by finding the optimal mixture of the left and right monaural beamformers by adapting $w_l$ and $w_r$ to maximize the noise reduction on each hearing device. The noise reduction gain is computed by comparing the bilaterally beamform output signals from each hearing devices with the monaural beamform output signals. It may be envisaged that if no significant improvement in noise reduction (such as with respect to an improvement threshold) is detected, the disclosed method triggers a shift to another mode, such as a monaural beamforming mode. It may also be envisaged that the estimated noise reduction gain is divided by a constant (e.g. 2), and if N/constant is not significant, the disclosed method triggers a shift to another mode e.g. by reducing the beamforming directivity index in the exemplary manners disclosed in this example. The noise reduction gain (denoted N, and expressed in dB) may be estimated by comparing the bilaterally beamform output signals from each hearing devices with the monaural beamform output signals of each hearing devices. The noise reduction gain may be synchronized between the hearing devices (e.g. by taking the average or maximum or minimum noise reduction gain over both ears). Alternatively, the hearing devices may use separate estimates to steer the beamforming in the left or right hearing devices individually. In the present example, the hearing devices are assumed to be synchronized in that the noise reduction gain is held at both hearing devices. A step parameter Δ may be defined as a function of N, such that Δ goes to 1 when N goes to a large value and Δ goes to 0 when N goes to a small or negative value. For example, step parameter Δ may be defined as e.g.

$$\Delta = \max\left(0, \min\left(1, \frac{N - thldLow}{thldHigh - thldLow}\right)\right) \quad (5)$$

Where thldLow denotes a lower threshold and thldHigh denotes an upper threshold in dB on the noise reduction gain. The thresholds (e.g. the low threshold and the high threshold) may be based on the hearing loss of the user and/or on preference feedback from the user during fitting and/or operation. The present disclosure is not limited to the above definition of Δ. Non-linear mappings from N to Δ is also contemplated. It may be envisaged that such mappings correspond better to the perceptual benefit of the respective signal processing strategies and the above only serves as a simple example. Depending on the noise reduction gain N, the aggressiveness of beamforming algorithm can be steered e.g. by sacrificing some benefit in the directivity index to introduce situational awareness and/or spatial cues. This is performed by determining the first parameter e.g.:

i. On the left hearing device, by replacing the weight $w_l$ by $\Delta*w_l$ or by $(w_l+\Delta)$;

On the right hearing device, by replacing the weight $w_r$ by $\Delta*w_r$ or by $(w_r-\Delta)$ It may be envisaged that in some scenarios, Δ is zero, then bilateral beamforming becomes monaural beamforming in one of the hearing devices. When Δ is zero, the noise reduction gain is estimated by comparing the monaural beamforming output signals with the output signal obtained based on the pinna restoration pattern. If there is no significant noise reduction gain, then steering to the pinna restoration mode in a similar way as is done above on both hearing devices.

It may be envisaged that the noise reduction gain is estimated by comparing the monaural beamform output signal of the hearing device acting as the focus ear with the bilateral beamform output signal of the hearing device acting as the focus ear. It may be envisaged that if there is a significant gain for bilateral beamforming, then steering to the bilateral listening mode, at the hearing device acting as the focus ear where a bilateral beamform output signal is generated in a similar way as is done above. It may be envisaged that the corresponding steering is performed at the hearing device acting as the monitor ear. It may be envisaged that when the hearing device operate in a mode indicative of monaural beamforming on the focus ear, the noise reduction gain is estimated by comparing the monaural beamform output signal with the output signal of the pinna restoration mode. If there is no significant gain, then steering to the pinna restoration mode is performed in a similar way as is done above on both hearing devices. In the present example, the step parameter Δ is broadband. It may be envisaged that the step parameter is made frequency dependent and that an optimal trade off over all frequencies is performed. It may be envisaged that the frequency dependent step parameter is given as input to another algorithm that uses a rule base to obtain a smoothed value of Δ over frequencies. For example, Δ may be restricted to be monotonic over frequency, or to be constant below and above a certain frequency and steer both the value below and above this frequency as well as this frequency itself based on the realization of Δ, etc. The rule base may be extended in many ways, e.g. instead of comparing the SNR benefit obtained by shifting from a less to a more directional mode, the SNR benefit may be linked to the SNR of the less directional mode itself: if the SNR is good enough, a shift to a more aggressive directional mode is not performed even if a significant SNR benefit may be obtained. This is because the more aggressive mode comes at a cost in e.g. spatial cue preservation and/or environmental awareness, etc. Additionally, or alternatively, it may be envisaged to exploit the position of a certain source, e.g. a shift to a bilateral beamforming mode when there is speech from the front hemisphere only may be triggered based on the location and/or the SNR and/or to the overall noise level. Additionally, or alternatively, it may be envisaged to exploit an own voice detector e.g.: an own voice detector is used to monitor how involved the user is in a conversation, e.g. when the user is involved in the conversation, the thresholds are adapted to steer to a mode that improves the SNR sooner than when the user is not actively involved in a conversation. In other words, other metrics than the SNR alone may be used to steer the settings of the signal processing algorithms at the hearing device e.g.: overall noise level, the direction from which a certain sound is coming, and/or an own voice detector.

It may be seen as an advantage of the present disclosure that the hearing device automatically adapts to an appropriate hearing device settings (e.g. signal processing settings, beamforming settings) depending on the amount of signal to noise ratio benefit that can be obtained by a more directional mode at the expense of spatial cues, a more natural sound environment and, possibly, environmental awareness. The signal processing settings include for example: the time constants of an AGC, control of the amount of noise reduction provided by a spectral subtraction algorithm, enable/disable bilateral compression which synchronizes the amount of gain applied in the compressor on both ears to restore spatial cues, etc.

In one or more exemplary methods and hearing devices, an improvement threshold is configured to determine if there is a significant benefit for a certain signal processing scheme or a certain combination of beamform signals. An improvement threshold may be determined based on user preferences. The present disclosure may exploit one or more improvement thresholds, which are obtained from e.g. a user profile of the hearing device user. The user profile may be generated in many ways, e.g. by basing the user profile on the hearing loss of the user, on the cognitive abilities of the user, on the life-style of the user, by using on-line questionnaires, by making the profile with a hearing care professional at the dispenser office. The user profile may either be a general depiction of the user or be linked to different preferences for different environments e.g.: the user may indicate to have different priorities in different environments. The user profile may be adapted on-line by obtaining feedback from the user during operation, e.g. via an application on a mobile phone or by monitoring the user's behavior to detect user involvement and the sources that he is monitoring. The on-line user feedback may be used to change the user profile and thereby change the steering behavior of the hearing device to the preferences of the user.

This disclosure relates to a hearing device comprising an antenna for converting a first wireless input signal of a first external source to an antenna output signal; and a radio transceiver coupled to the antenna for converting the antenna output signal to a transceiver input signal. In other words, the hearing device comprises an antenna for converting one or more wireless input signals, e.g. a first wireless input signal and/or a second wireless input signal, to an antenna output signal. The wireless input signal(s) origin from external source(s), such as spouse microphone device(s), wireless TV audio transmitter, and/or a distributed microphone array associated with a wireless transmitter. The hearing device comprises a radio transceiver coupled to the antenna for converting the antenna output signal to a transceiver input signal. Wireless signals from different external sources may be multiplexed in the radio transceiver to a transceiver input signal or provided as separate transceiver input signals on separate transceiver output terminals of the radio transceiver. The hearing device may comprise a plurality of antennas and/or an antenna may be configured to be operate in one or a plurality of antenna modes. The transceiver input signal comprises a first transceiver input signal representative of the first wireless signal from a first external source.

A hearing device is disclosed. The hearing device may be a hearable or a hearing aid, wherein the processing unit is configured to compensate for a hearing loss of a user.

The hearing device may be of the behind-the-ear (BTE) type, in-the-ear (ITE) type, in-the-canal (ITC) type, receiver-in-canal (RIC) type or receiver-in-the-ear (RITE) type. The hearing aid may be a binaural hearing aid. The hearing device may comprise a first earpiece and a second earpiece, wherein the first earpiece and/or the second earpiece is an earpiece as disclosed herein.

The hearing device comprises a set of microphones comprising a first microphone for provision of a first microphone signal and a second microphone for provision of a second microphone signal. The set of microphones may comprise one or more microphones. The set of microphones may comprise N microphones for provision of N microphone signals, wherein N is an integer in the range from 1 to 10. In one or more exemplary hearing devices, the number N of microphones is two, three, four, five or more. The set of microphones may comprise a third microphone for provision of a third microphone signal.

The hearing device comprises a beamforming module connected to the first microphone and the second microphone. In one or more exemplary hearing devices where the hearing device comprises a set of microphones may comprise N microphones for provision of N microphone signals, wherein N is an integer in the range from 1 to 10, the beamforming module is connected to any one or more microphones of the set of microphones. For example, the beamforming module may be connected to each of the N microphones.

The beamforming module comprises a first beamformer for providing a first beamform signal based on the first microphone signal and the second microphone signal, and a second beamformer for providing a second beamform signal based on the first microphone signal and the second microphone signal. The beamforming module comprises a beamforming controller. The hearing device comprises a processing unit for processing input signals and providing an electrical output signal based on input signals; and a receiver for converting the electrical output signal to an audio output signal. The processing unit may be connected to the radio transceiver for processing the transceiver input signal. The processing unit may be connected the first microphone for processing the first microphone signal. The processing unit may be connected the second microphone if present for processing the second microphone signal. The processing unit may comprise one or more A/D-converters for converting analog microphone signal(s) to digital pre-processed microphone signal(s). The processing unit may be connected to the beamforming module for processing output beamform signals.

The beamforming controller is configured to determine a first parameter based on the first beamform signal; and combine the first beamform signal and the second beamform signal based on the first parameter for provision of an output beamform signal. In one or more exemplary hearing devices, the beamforming controller is configured to determine the first parameter based on the first beamform signal and/or the second beamform signal. For example, a parameter (such as the first parameter, a second parameter, a third parameter, a fourth parameter) may comprise a signal-to-noise ratio, a noise gain, a noise reduction gain, a benefit in signal-to-noise ratio, and/or any related metric. A parameter (such as the first parameter, a second parameter, a third parameter) is seen as indicative of a mode, such as a first mode, a second mode, or a third mode. A mode relates to a mode of operation of the hearing device. For example, a mode may be selected among a first mode, a second mode, and/or a third mode. The beamforming controller is configured to combine the first beamform signal and the second beamform signal based on the first parameter, so as to initiate, perform and/or complete a shift from a mode to a target mode.

In one or more exemplary hearing devices, the beamforming controller is configured to combine the first beamform signal and the second beamform signal based on the first parameter by reducing a first gain for the first beamform signal from a first primary gain to a first secondary gain. In one or more exemplary hearing devices, the beamforming controller is configured to combine the first beamform signal and the second beamform signal based on the first parameter by stepwise reducing a first gain for the first beamform signal from a first primary gain to a first secondary gain. The stepwise reduction may be performed using a step parameter in range [0-1]. In one or more exemplary hearing devices, the beamforming controller is configured to combine the first beamform signal and the second beamform signal based on the first parameter by reducing a first gain for the first beamform signal from a first primary gain to a first secondary gain (e.g. by applying a continuous reduction scheme based on a step parameter such as Δ in the illustrative example above, such as in equation (5)).

In one or more exemplary hearing devices, the beamforming controller is configured to combine the first beamform signal and the second beamform signal based on the first parameter by increasing a second gain for the second beamform signal from a second primary gain to a second secondary gain. In one or more exemplary hearing devices, the beamforming controller is configured to combine the first beamform signal and the second beamform signal based on the first parameter by stepwise increasing a second gain for the second beamform signal from a second primary gain to a second secondary gain. In one or more exemplary hearing devices, the beamforming controller is configured to combine the first beamform signal and the second beamform signal based on the first parameter by increasing a second gain for the second beamform signal from a second primary gain to a second secondary gain (e.g. by applying a continuous increase scheme based on a step parameter such as Δ in the illustrative example above, such as in equation (5)).

In one or more exemplary hearing devices, the beamforming controller is configured to obtain a third beamform signal based on the first microphone signal and the second microphone signal.

In one or more exemplary hearing devices, the beamforming controller is configured to combine the first beamform signal, the second beamform signal and the third beamform signal based on the first parameter for provision of an output beamform signal.

Throughout, the same reference numerals are used for identical or corresponding parts.

FIG. 1 illustrates an exemplary hearing device according to this disclosure. The hearing device 2 is configured for use in a binaural hearing system comprising the hearing device and a contralateral hearing device. The hearing device 2 (left/right) hearing device of binaural hearing system) may comprise a transceiver module 4 for (e.g. wireless) communication with the contralateral (right/left) hearing device (not shown in FIG. 1) of the binaural system. The transceiver module 4 may comprise antenna 4A and a radio transceiver 4B. The transceiver module 4 is configured for provision a transceiver input signal, such as a contralateral beamform signal 5 received from the contralateral hearing device.

The hearing device 2 comprises a set of microphones comprising a first microphone 6 and a second microphone 8 for provision of a first microphone signal 6A and a second microphone signal 8A, respectively. The hearing device 2 comprises a beamforming module 10 connected to the first microphone 6 and the second microphone 8 for receiving and processing the first microphone signal 6A, the second microphone signal 8A and optionally the contralateral signal 5. The beamforming module 10 comprises a first beamformer 10A for providing a first beamform signal 11A based on the first microphone signal 6A and the second microphone signal 8A, and a second beamformer 10B for providing a second beamform signal 11B based on the first microphone signal 6A and the second microphone signal 8A. The beamforming module 10 is configured to output a first beamform input signal 11A based on the first microphone signal 6A and the second microphone signal 8A and a second beamform signal 11B based on the first microphone signal 6A and the second microphone signal 8A. The beamforming module 10 comprises a beamforming controller 12. The beamforming controller 12 may be connected to the first beamformer 10A and to the second beamformer 10B. The beamforming controller 12 may be configured to obtain the first beamform signal 11A and the second beamform signal 11B. The beamforming controller 12 is configured to determine a first parameter (e.g. SNR, noise gain, and/or noise reduction gain) based on the first beamform signal 11A and possibly the second beamform signal 11B. The beamforming controller 12 is configured to combine the first beamform signal 11A and the second beamform signal 11B based on the first parameter for provision of an output beamform signal 14A. The beamforming controller 12 is configured to provide the output beamform signal 14A to the processing unit 16. The beamforming controller 12 may be configured to output a signal 14B to be transmitted to the contralateral hearing device, wherein the signal 14B may be indicative of the beamforming scheme or signaling scheme applied at the hearing device 2.

The beamforming controller may be configured to combine the first beamform signal 11A and the second beamform signal 11B based on the first parameter by reducing (e.g. stepwise and/or continuously) a first gain for the first beamform signal 11A from a first primary gain to a first secondary gain.

The beamforming controller may be configured to combine the first beamform signal 11A and the second beamform signal 11B based on the first parameter by increasing (e.g. stepwise and/or continuously) a second gain for the second beamform signal 11B from a second primary gain to a second secondary gain.

The beamforming controller 12 may be configured to determine a second parameter (e.g. SNR, noise gain, and/or noise reduction gain) based on the second beamform signal 11B and possibly the first beamform signal 11A. The beamforming controller 12 is configured to combine the first beamform signal 11A and the second beamform signal 11B based on the second parameter for provision of an output beamform signal 14A.

The beamforming controller 12 may be configured to obtain a third beamform signal based on the first beamform signal 11A and the second beamform signal 11B. The beamforming controller 12 is configured to combine the first beamform signal 11A and the second beamform signal 11B and the third beamform signal based on the first parameter for provision of an output beamform signal 14A.

The beamforming controller 12 may be configured to determine a third parameter based (e.g. SNR, noise gain, and/or noise reduction gain) on the third beamform signal. The beamforming controller 12 is configured to combine the first beamform signal 11A and the second beamform signal 11B and/or third beamform signal based on the third parameter for provision of an output beamform signal 14A.

The beamforming controller 12 may be configured to control the first beamformer 10A based on the first beamform signal 11A and the first parameter, such as via control signal 13A. The beamforming controller 12 may be configured to control the second beamformer 10B based on the second beamform signal 11B and the first parameter, such as via control signal 13B.

The hearing device 2 comprises a processing unit 16 for processing output beamform signal 14A and providing an electrical output signal 16A based on the output beamform signal 14A, and a receiver 18 for converting the electrical output signal 16A to an audio output signal.

Figure 2:
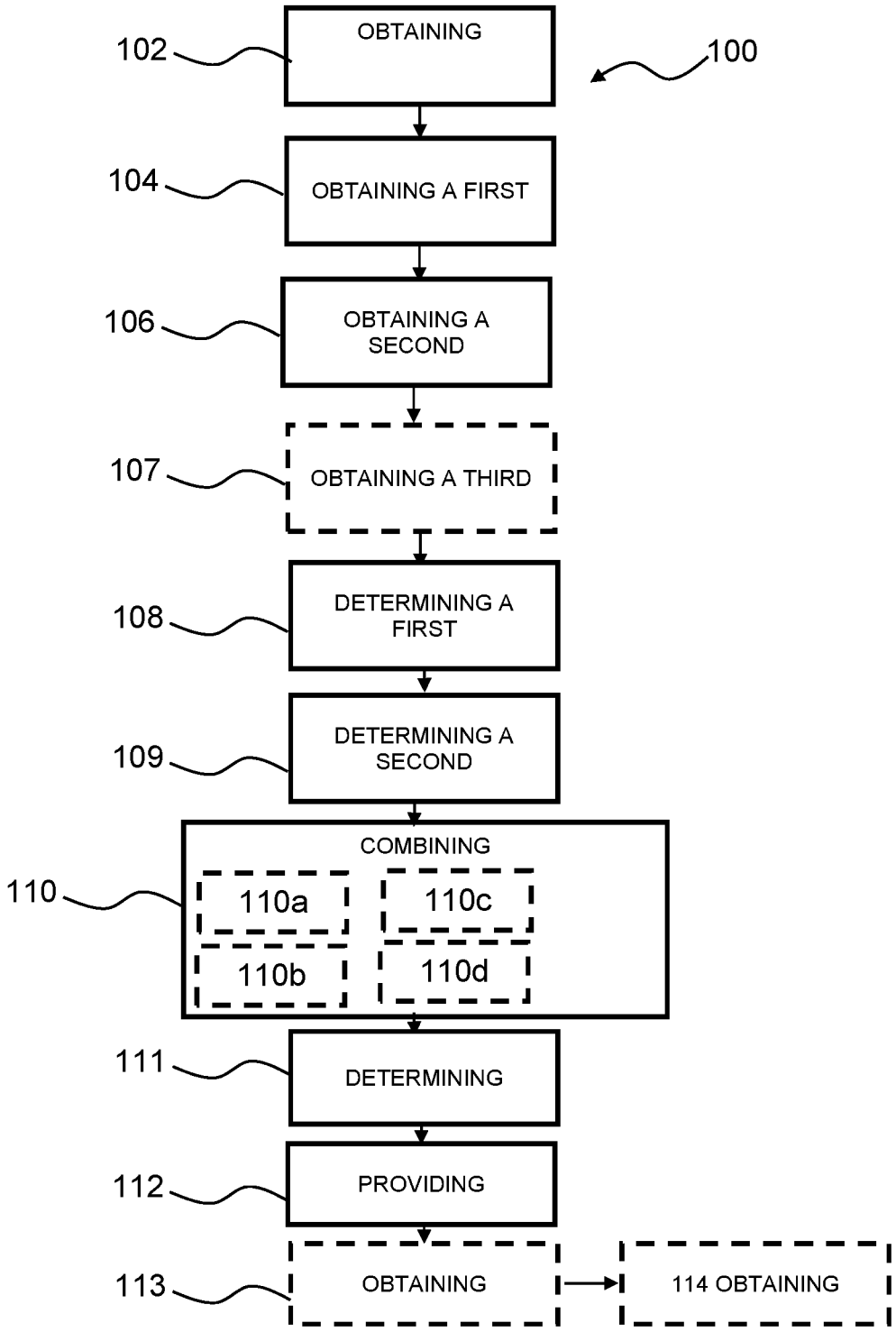
FIG. 2 is a flow diagram of an exemplary method according to this disclosure.

FIG. 2 is a flow chart of an exemplary method 100 of operating a hearing device according to this disclosure. The method 100 relates to operating a hearing device, such as to steering of the signal processing (in various modes disclosed herein) of the hearing device. The method 100 comprises obtaining 102 a first microphone signal and a second microphone signal (e.g. receiving a first microphone signal and a second microphone signal). The method 100 comprises obtaining 104 a first beamform signal based on the first microphone signal and the second microphone signal (e.g. generating a first beamform signal). The method 100 comprises obtaining 106 a second beamform signal based on the first microphone signal and the second microphone signal (e.g. generating a second beamform signal). The method 100 comprises determining 108 a first parameter (e.g. SNR, noise gain, and/or noise reduction gain) based on the first beamform signal. In one or more exemplary methods, determining 108 a first parameter may be performed based on the first beamform signal and/or the second beamform signal. The method 100 comprises combining 110 the first beamform signal and the second beamform signal based on the first parameter for provision of an output beamform signal. In one or more exemplary methods, combining 110 the first beamform signal and the second beamform signal comprises reducing 110*a* a first gain for the first beamform signal from a first primary gain to a first secondary gain (e.g. reducing stepwise, e.g. with a step parameter in range [0-1] and/or continuously using a reduction scheme/function dependent on the step parameter). In one or more exemplary methods, combining 110 the first beamform signal and the second beamform signal comprises increasing 110*b* a second gain for the second beamform signal from a second primary gain to a second secondary gain (e.g. increasing stepwise, e.g. with a step parameter in range [0-1] and/or continuously using an increase scheme/function dependent on the step parameter).

In one or more exemplary methods, the method 100 comprises obtaining 107 a third beamform signal based on the first microphone signal and the second microphone signal (e.g. generating a third beamform signal).

In one or more exemplary methods, combining 110 the first beamform signal and the second beamform signal based on the first parameter for provision of an output beamform signal comprises combining 110*c* the first beamform signal, the second beamform signal and the third beamform signal based on the first parameter for provision of an output beamform signal.

In one or more exemplary methods, the method comprises controlling 114 a first beamformer based on the first beamform signal and/or the first parameter. The hearing device may comprise the first beamformer. The beamforming controller may be configured to control the first beamformer and optionally a second beamformer.

In one or more exemplary methods, the method 100 comprises determining 109 a second parameter (e.g. SNR, noise gain, and/or noise reduction gain) based on the second beamform signal. In one or more exemplary methods, the method comprises determining 111 a third parameter (e.g. SNR, noise gain, and/or noise reduction gain) based on the third beamform signal. The second or third parameter is seen as indicative a mode, such as a first mode, a second mode, and/or a third mode.

In one or more exemplary methods, combining 110 the first beamform signal and the second beamform signal based on the first parameter for provision of an output beamform signal comprises combining 110*d* the first beamform signal and the second beamform signal based on the second parameter and/or third parameter for provision of an output beamform signal. Combining the first beamform signal and the second beamform signal based on the second parameter and/or third parameter may be performed so as to initiate, perform and/or complete a shift from a given mode to another mode.

In one or more exemplary methods, the method comprises obtaining 113 a contralateral signal from a contralateral hearing device (e.g. receiving a contralateral signal). The contralateral signal may be indicative of the mode carried out at the contralateral hearing device.

The method 100 comprises providing 112 the output beamform signal for further processing including hearing loss compensation.

As used in this specification, the term "processing unit" may refer to software, hardware, or a combination of the foregoing. Also, the term "processing unit" may be a processor, an integrated circuit, a part of a processor, or a part of an integrated circuit. In some embodiments, the processing unit includes at least some hardware. Also, in some embodiments, the processing unit 16 may be a part of a processor that also implements the beamforming module 10. In other embodiments, the processing unit 16 may be a processor that is coupled to the beamforming module 10.

Similarly, as used in this specification, the term "module" (e.g., as in "beamforming module") may refer to software, hardware, or a combination of the foregoing. Also, the term "module" may be a processor, an integrated circuit, a part of a processor, or a part of an integrated circuit. In some embodiments, a module includes at least some hardware.

The use of the terms "first", "second", "third" and "fourth", "primary", "secondary", "tertiary" etc. does not imply any particular order, but are included to identify individual elements. Moreover, the use of the terms "first", "second", "third" and "fourth", "primary", "secondary", "tertiary" etc. does not denote any order or importance, but rather the terms "first", "second", "third" and "fourth", "primary", "secondary", "tertiary" etc. are used to distinguish one element from another. Note that the words "first", "second", "third" and "fourth", "primary", "secondary", "tertiary" etc. are used here and elsewhere for labelling purposes only and are not intended to denote any specific spatial or temporal ordering. Furthermore, the labelling of a first element does not imply the presence of a second element and vice versa.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

LIST OF REFERENCES

2 hearing device
4 transceiver module
4A antenna
4B radio transceiver
5 contralateral signal
6 first microphone
6A first microphone input signal
8 second microphone
8A second microphone input signal
10 beamforming module
10A first beamformer
10B second beamformer
11A first beamform signal
11B second beamform signal
12 beamforming controller
13A control signal to the first beamformer
13B control signal to the second beamformer
14A output beamform signal
14B signal to the transceiver module for the contralateral hearing device
16 processing unit
16A electrical output signal
18 receiver
100 method of operating a hearing device
102 obtaining a first microphone signal and a second microphone signal
104 obtaining a first beamform signal based on the first microphone signal and the second microphone signal
106 obtaining a second beamform signal based on the first microphone signal and the second microphone signal
107 obtaining a third beamform signal based on the first microphone signal and the second microphone signal
108 determining a first parameter based on the first beamform signal
109 determining a second parameter based on the second beamform signal
110 combining the first beamform signal and the second beamform signal based on the first parameter for provision of an output beamform signal
110*a* reducing a first gain for the first beamform signal from a first primary gain to a first secondary gain
110*b* increasing a second gain for the second beamform signal from a second primary gain to a second secondary gain
110*c* combining the first beamform signal, the second beamform signal and the third beamform signal based on the first parameter for provision of an output beamform signal
110*d* combining the first beamform signal and the second beamform signal based on the second parameter and/or third parameter for provision of an output beamform signal
111 determining a third parameter based on the third beamform signal
112 providing the output beamform signal for further processing including hearing loss compensation
113 obtaining a contralateral signal from a contralateral hearing device
114 controlling a first beamformer based on the first beamform signal and/or the first parameter

The invention claimed is:

1. A method of operating a hearing device, comprising:
obtaining a first microphone signal and a second microphone signal;
obtaining a first beamform signal based on the first microphone signal and the second microphone signal;
obtaining a second beamform signal based on the first microphone signal and the second microphone signal;
determining a first parameter based on the first beamform signal, wherein the first parameter comprises a weight for the first beamform signal;
combining the first beamform signal and the second beamform signal based on the first parameter for provision of an output beamform signal; and
providing the output beamform signal for hearing loss compensation.

2. The method according to claim 1, further comprising obtaining a third beamform signal based on the first microphone signal and the second microphone signal.

3. The method according to claim 2, wherein the first beamform signal and the second beamform signal are combined with the third beamform signal based on the first parameter for provision of the output beamform signal.

4. The method according to claim 1, further comprising determining a second parameter based on the second beamform signal.

5. The method according to claim 4, further comprising determining a third parameter based on a third beamform signal.

6. The method according to claim 4, wherein the act of combining the first beamform signal and the second beamform signal is also based on the second parameter and/or the third parameter for provision of the output beamform signal.

7. The method according to claim 1, further comprising obtaining a contralateral signal from a contralateral hearing device.

8. A method of operating a hearing device, comprising:
obtaining a first microphone signal and a second microphone signal;
obtaining a first beamform signal based on the first microphone signal and the second microphone signal;
obtaining a second beamform signal based on the first microphone signal and the second microphone signal;
determining a first parameter based on the first beamform signal;
combining the first beamform signal and the second beamform signal based on the first parameter for provision of an output beamform signal; and
providing the output beamform signal for hearing loss compensation;
wherein the act of combining the first beamform signal and the second beamform signal comprises reducing a first gain for the first beamform signal from a first primary gain to a first secondary gain.

9. The method according to claim 8, wherein the act of combining the first beamform signal and the second beamform signal comprises increasing a second gain for the second beamform signal from a second primary gain to a second secondary gain.

10. A method of operating a hearing device, comprising:
obtaining a first microphone signal and a second microphone signal;
obtaining a first beamform signal based on the first microphone signal and the second microphone signal;
obtaining a second beamform signal based on the first microphone signal and the second microphone signal;
determining a first parameter based on the first beamform signal;
combining the first beamform signal and the second beamform signal based on the first parameter for provision of an output beamform signal; and
providing the output beamform signal for hearing loss compensation;
wherein the method further comprises controlling a first beamformer based on the first beamform signal and/or the first parameter.

11. A method of operating a hearing device, comprising:
obtaining a first microphone signal and a second microphone signal;
obtaining a first beamform signal based on the first microphone signal and the second microphone signal;
obtaining a second beamform signal based on the first microphone signal and the second microphone signal;
determining a first parameter based on the first beamform signal;
combining the first beamform signal and the second beamform signal based on the first parameter for provision of an output beamform signal; and
providing the output beamform signal for hearing loss compensation;
wherein the act of combining the first beamform signal and the second beamform signal comprises increase a gain for the second beamform signal from a primary gain to a secondary gain.

12. A hearing device comprising:
a set of microphones comprising a first microphone for provision of a first microphone signal, and a second microphone for provision of a second microphone signal;
a beamforming module connected to the first microphone and the second microphone, wherein the beamforming module comprises a first beamformer for providing a first beamform signal based on the first microphone signal and the second microphone signal, and a second beamformer for providing a second beamform signal based on the first microphone signal and the second microphone signal, wherein the beamforming module comprises a beamforming controller;
a processing unit configured to provide an electrical output signal based on an input signal; and
a receiver configured to provide an audio output signal based on the electrical output signal;
wherein the beamforming controller is configured to:
determine a first parameter based on the first beamform signal, wherein the first parameter comprises a weight for the first beamform signal; and
combine the first beamform signal and the second beamform signal based on the first parameter for provision of an output beamform signal.

13. The hearing device according to claim 12, wherein the beamforming controller is configured to obtain a third beamform signal based on the first microphone signal and the second microphone signal.

14. The hearing device according to claim 12, wherein the beamforming controller is configured to combine the first beamform signal, the second beamform signal and a third beamform signal based on the first parameter for provision of the output beamform signal.

15. The hearing device according to claim 12, further comprising:
an antenna for converting a first wireless input signal of a first external source to an antenna output signal;
a radio transceiver coupled to the antenna for converting the antenna output signal to a transceiver input signal;
wherein the radio transceiver is coupled to the processing unit.

16. A hearing device comprising:
a set of microphones comprising a first microphone for provision of a first microphone signal, and a second microphone for provision of a second microphone signal;
a beamforming module connected to the first microphone and the second microphone, wherein the beamforming module comprises a first beamformer for providing a first beamform signal based on the first microphone signal and the second microphone signal, and a second beamformer for providing a second beamform signal based on the first microphone signal and the second microphone signal, wherein the beamforming module comprises a beamforming controller;
a processing unit configured to provide an electrical output signal based on an input signal; and
a receiver configured to provide an audio output signal based on the electrical output signal;
wherein the beamforming controller is configured to:
determine a first parameter based on the first beamform signal; and
combine the first beamform signal and the second beamform signal based on the first parameter for provision of an output beamform signal; and
wherein the beamforming controller is configured to combine the first beamform signal and the second beamform signal based on the first parameter by reducing a first gain for the first beamform signal from a first primary gain to a first secondary gain.

17. The hearing device according to claim 16, wherein the beamforming controller is configured to combine the first beamform signal and the second beamform signal based on the first parameter by increasing a second gain for the second beamform signal from a second primary gain to a second secondary gain.

18. A hearing device comprising:
a set of microphones comprising a first microphone for provision of a first microphone signal, and a second microphone for provision of a second microphone signal;
a beamforming module connected to the first microphone and the second microphone, wherein the beamforming module comprises a first beamformer for providing a first beamform signal based on the first microphone signal and the second microphone signal, and a second beamformer for providing a second beamform signal based on the first microphone signal and the second microphone signal, wherein the beamforming module comprises a beamforming controller;
a processing unit configured to provide an electrical output signal based on an input signal; and
a receiver configured to provide an audio output signal based on the electrical output signal;
wherein the beamforming controller is configured to:
determine a first parameter based on the first beamform signal; and combine the first beamform signal and the second beamform signal based on the first parameter for provision of an output beamform signal; and wherein the beamforming controller is configured to combine the first beamform signal and the second beamform signal based on the first parameter by increasing a gain for the second beamform signal from a primary gain to a secondary gain.

* * * * *